United States Patent [19]

Larrecq et al.

[11] Patent Number: 4,662,427

[45] Date of Patent: May 5, 1987

[54] VIBRATING INGOT MOLD FOR CONTINUOUS CASTING OF METALS

[75] Inventors: Michel Larrecq, Metz; Michel Nogues, Maisons-Laffitte, both of France

[73] Assignee: IRSID, Maizieres-Les-Metz, France

[21] Appl. No.: 780,509

[22] Filed: Sep. 26, 1985

[30] Foreign Application Priority Data

Sep. 26, 1984 [FR] France ..... 84 14759

[51] Int. Cl.[4] ..... B22D 11/04

[52] U.S. Cl. ..... 164/416; 164/478

[58] Field of Search ..... 164/478, 71.1, 416, 164/260

[56] References Cited

FOREIGN PATENT DOCUMENTS 56-11151 2/1981 Japan ..... 164/478

899239 1/1982 U.S.S.R. ..... 164/478

*Primary Examiner*—Kuang Y. Lin

*Attorney, Agent, or Firm*—Pollock, Vande Sande & Priddy

[57] ABSTRACT

A vibrating ingot mold for the continuous casting of metals, particularly of steel, comprising at least one ultrasonic transducer (8) mounted on the edge (20) of one end of the interal tubular element (14) of the mold, in an extension of that element, and oriented to transmit to that element the ultrasonic vibrations which it generates in a longitudinal direction, parallel or substantially parallel to the casting axis (A) in the mold. By reducing friction between the cast metal and the inner mold wall, the mold structure promotes lubrication and improves the quality of the surfaces of the cast products while reducing the danger of breakouts. It can be used with vertical, inclined, curved and horizontal continuous casting plants.

4 Claims, 3 Drawing Figures

VIBRATING INGOT MOLD FOR CONTINUOUS CASTING OF METALS

FIELD OF THE INVENTION

The present invention relates to the placement into vibration by ultrasound of the internal tubular element of a continuous casting mold.

BACKGROUND OF THE INVENTION

The internal tubular element is a structure made of copper, or of copper alloy, manufactured from a block or constituted by four assembled plates defining a passage for the cast product and which is energetically cooled, generally by circulation of water, in order to cause peripheral solidification of the cast metal.

One of the major problems encountered in the continuous casting of metals, especially of steel, whether this casting is of the vertical, curved or horizontal type, is that the solidified shell resulting from peripheral cooling of the cast bar tends to catch on the internal surface of the tubular element. Because of this catching, fissures may be produced in the solidified crust as the bar progresses in the mold, such fissures being the cause of breakouts and surface defects in the products which are obtained.

It is known, e.g., from Belgian Patent No. 886,924, French Patent No. 2,471,821 and Japanese Patent No. 86432/79, to reduce friction, and thus to promote lubrication between the cast metal and the inner mold wall, by applying to the latter, by means of transducers attached laterally to the internal tubular element, ultrasound vibrations in a direction perpendicular to the surface of the element, i.e., perpendicular to the casting axis. In this manner, the danger of breakouts could be limited and the surface quality of the cast products improved.

However, this known technique has certain important disadvantages. Under the effect of such vibrations, the wall of the tubular element is subjected to deformations toward the mold interior, deformations whose amplitude reaches a maximum only in the vicinity of the location where the ultrasonic transducer is applied against the said wall. The result is a limited overall reduction in the frictional forces, generally of the order of 50%, unless several transducers are provided, as proposed in the French patent.

Moreover, the very large mass of liquid steel present in the mold tends, through its inertia, to resist the vibrations transmitted at the wall. In order to mitigate this effect, it is necessary to reinforce the latter and, consequently, to make use of heavy and onerous molds and too complex structures because of the internal channels required for cooling this type of mold.

Also known, from British Patent No. 2,108,878, is a technique for bringing into longitudinal oscillation a continuous casting mold supported for this purpose on oscillators attached to the frame of a casting machine. In this technique, it is thus the entire mold assembly which oscillates, not only the internal tubular element, so that it would not be possible to place into oscillation at ultrasonic frequency such a mass of several tons, not to mention more than ten tons in the case of casting products of large cross section, such as slabs.

OBJECT OF THE INVENTION

The present invention has the object of proposing a solution for placing into ultrasonic vibration a continuous casting mold which overcomes the disadvantages of the known techniques.

SUMMARY OF THE INVENTION

For this purpose, the invention comprises a vibrating ingot mold for the continuous casting of metals, of the type comprising at least one ultrasonic transducer applied against the internal tubular element of the mold in contact with the cast metal. The transducer is mounted at the edge of an end of the tubular element in an extension thereof, and is oriented to transmit to the tubular element the ultrasonic vibrations which it generates in a longitudinal direction parallel, or substantially parallel, to the casting axis in the mold.

It will be understood that, according to the invention, the direction of transmission of the vibrations to the mold wall is such that the mass of the liquid cast product present in the mold does not have a dampening effect on the transmitted vibrations. It is hence not necessary, as in the above mentioned prior art techniques, to reinforce the wall in order to retain the resonance conditions therein. The mold can thus be constructed in the conventional manner, i.e., with a wall of small thickness cooled by means of a cooling fluid circulating in an annular space surrounding the outer face of the wall. In other words, the process according to the invention can be applied to existing molds without particular adaptation being required.

Moreover, in conformity to the invention which assures longitudinal vibration of the wall, the vibratory efficiency can be optimal, and this constitutes another advantage with respect to the prior art processes in which the vibrations are transmitted perpendicularly to the casting axis.

It is to be noted that the ultrasonic vibrations according to the invention are advantageously of a strength whose frequency is preferably above or equal to 16 kHz, and for example are in the range of 16 and 60 kHz, in order to avoid excessively annoying sounds.

The ultrasonic vibration generator may be of different types. It may, for example, be constituted by a magnetostrictive transducer. However, piezoelectric transducers whose electrical-mechanical conversion yields can attain 95% are preferred.

In the case of use of a single piezoelectric transducer comprising, in a manner known per se, plates of piezoelectric material (such as a piezoelectric ceramic), maintained between a metallic transmitter mass and a metallic balancing mass, one of these masses is advantageously formed by the mold itself, one of the plates abutting the edge of an end of the mold. The particular arrangement has the advantage of overcoming the problems inherent in the coupling between the transducer and the piece to which the vibrations are to be transmitted, such coupling having to be very rigid when the vibrations are of great intensity, as is the case with strong ultrasounds.

According to the embodiment of a mold with a single transducer according to the invention, the plates of piezoelectric material have substantially the same shape as the cross section of the mold. A particularly rigid and compact mold may thus be obtained when these plates have the same dimensions as the said section, and when the metallic transmitter mass also has a transverse section having the shape and the dimensions of the mold cross section.

Furthermore, in order to achieve optimal resonance conditions of the mold, whose wall constitutes one of the metallic masses of the piezoelectric transducer, the dimensions of the metallic masses are so selected that the distance D, between the free end of the transmitter mass and the free end of the balancing mass, is such that $D=k(\lambda/2)$, where k is a whole number and $\lambda$ is the wavelength of the ultrasonic vibrations generated by the transducer.

It should be noted, finally, that in order to attain optimal reliability of the mold according to the invention, comprising a transducer with two superposed plates of piezoelectric material, the common plane of the two plates should be made to a coincide with a nodal plane of the ultrasonic waves which are generated. In practise, this comes down to so selecting the dimensions of the metallic transmitter mass that the distance D' between the free end of this mass and the plane of the joint of the two plates is such that $D'=\lambda/4+(\eta'\lambda)/2$, where n' is equal to zero or a whole number and $\lambda$ represents the wavelength of the ultrasonic vibrations generated by the transducer.

BRIEF DESCRIPTION OF THE DRAWINGS

In order that the invention may be more clearly understood, reference will now be made to the accompanying drawings, in which an embodiment of the invention is shown for purposes of illustration, to be described hereinbelow, and in which.

DESCRIPTION OF PREFERRED EMBODIMENT

Figure 1:
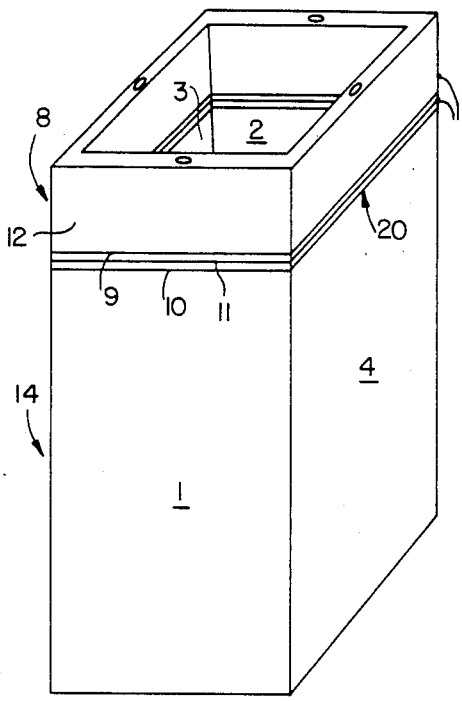
FIG. 1 is a schematic perspective view of an internal tubular element of a vertical type continuous casting mold for steel, according to the invention.

The continuous casting mold shown in the drawings is conventionally constituted by a tubular element 14 of copper or copper alloy defining a passage for the cast product 19 and surrounded at a distance by a jacket 5. Between them, the jacket 5 and the element 14 define a space for the circulation of cooling fluid (generally water), and connected at the exterior by two conduits 6 and 7, respectively for the inflow and outflow of the water. The function of this water circulation is to extract, through the wall of the element 14, a heat flux from the cast metal 19 sufficient to cause the formation of a peripheral solidified shell 18 maintaining the still liquid core at the outlet of the mold when the product is withdrawn in the direction indicated by the arrow carried by the casting axis A. Supply of the mold with liquid metal at its end opposite to that of withdrawal of the product has not been shown.

In the example under consideration, the tubular element 14 is formed of four assembled plates 1 to 4, defining the four internal lateral walls of a mold for the casting of products having a rectangular section.

An ultrasonic vibration transducer 8 is mounted on the edge 20 of the upper end of the tubular element 14. This is a piezoelectric transducer known per se. In the embodiment shown, it comprises an upper plate 9 and a lower plate 10, both of piezoelectric material, e.g., a piezoelectric ceramic such as lead titanozirconate. These two plates are arranged face to face, with a conducting sheet 11 therebetween, between a first, upper metallic mass 12, called "transmitter mass," and a second, lower metallic mass, constituted in the present case by the tubular element 14 itself. As clearly shown in the drawings, the plates 9, 10 and the metallic mass 12 extend along the entire upper edge 20 of the element 14. These plates 9, 10, having the shape and the dimensions of this edge of the metallic mass 12, have a section whose shape and dimensions correspond to those of the element 14, the lateral faces of this mass 12 thus constituting extensions of the lateral faces of the element 14.

Moreover, the stack formed by the upper metallic mass 12, the upper plate 9, the conducting sheet 11, the lower plate 10 and the tubular element 14, is kept assembled by means of tightening rods 13 passing right through the metallic mass 12, the plates 9, 10 and the conducting sheet 11 and engaging by their end in the thickness of the wall of element 14.

The described assembly is completed by rings 15 insulating the tightening rods 13 from the plates 9, 10 and the conducting sheet 11, and by electric contacts 16, 17 attached, respectively, with the conducting sheet 11 and the upper metallic mass 12, and connected to an A.C. source (not shown).

Also, in order to produce the conditions of resonance at element 14, the dimensions of the upper metallic mass 12 and of this element 14 are so selected that the distance D separating the upper end of the metallic mass 12 from the lower end of element 14 is equal to a whole number times the half-wavelength of the vibrations emitted by the transducer 8.

The height of the metallic mass 12 is so selected that the distance D' between the upper end of this mass 12 and the medial plane of the conducting sheet 11 is equal to $\lambda/4$ (modulo $\lambda/2$), $\lambda$ being the wavelength of the vibrations emitted by the transducer 8.

Figure 2:
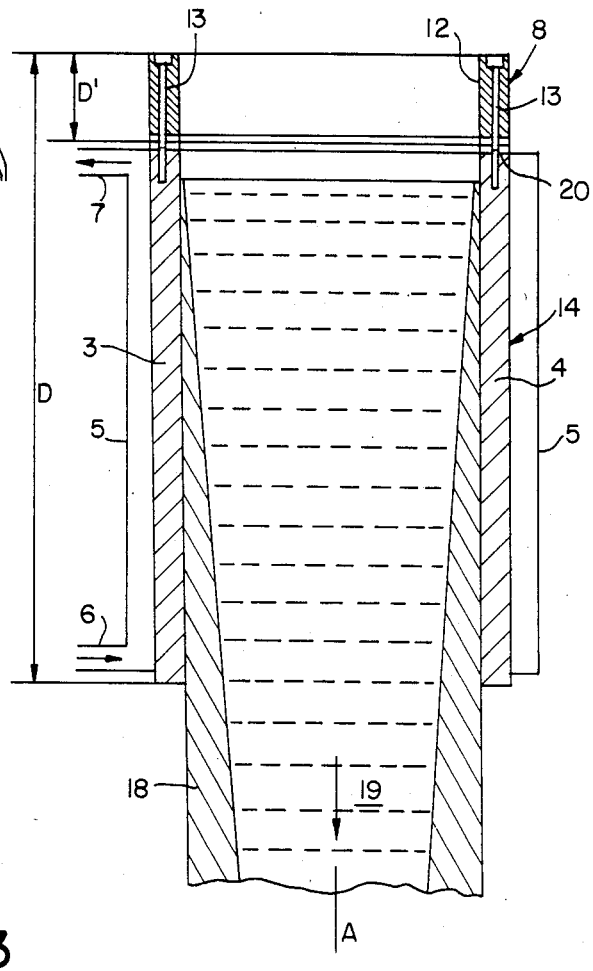
FIG. 2 is a longitudinal section in enlarged scale of the mold of FIG. 1.
Figure 3:
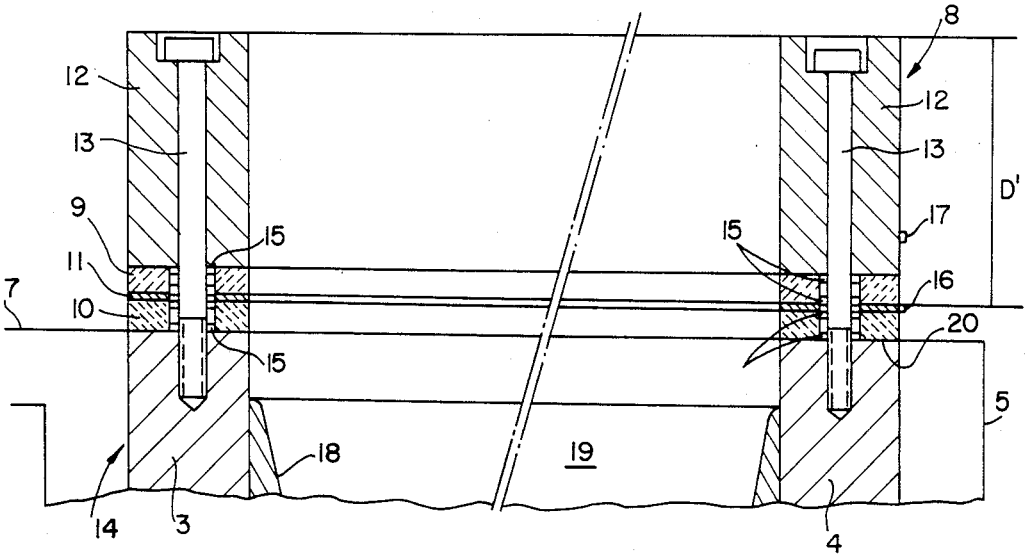
FIG. 3 is an enlarged and more detailed view of the upper end of the mold according to FIG. 2.

Taking into account the relative position of the upper metallic mass 12 and the internal tubular element 14 of the mold, the vibrations emitted by the transducer 8 are transmitted vertically to the said element, i.e., in the direction of the casting axis designated A in FIG. 2, these vibrations then spreading vertically along said wall, which then vibrates in the longitudinal direction of the mold. This vibration produces a reduction in the frictional forces at the interface of the copper element 14 and the solidified crust 18 surrounding the still liquid core 19 of the cast metal, with the result that the risk of catching or sticking of the said crust to the inner surface of element 14 is substantially reduced.

It will be noted that the invention can advantageously be combined with the usual practise of lubrication with oil or powder covering, as well as with the usual practise of inducing longitudinal mechanical oscillation of the mold assembly.

The invention applies not only to molds made of assembled plates, like those described hereinabove, and generally used for the casting of slabs or large blooms, but also to molds provided with monolithic machined internal tubular elements, generally employed for the casting of billets or of blooms, or round, square, rectangular or other shapes.

Care should be taken, for obvious reasons relating to metal fatigue, to assemble the internal tubular element to the rest of the mold body at attachment points located in the nodal planes of the ultrasonic wave.

In the described embodiment, the transducer comprises two ceramic plates, but the present invention can also be used with a stack of more than two superposed ceramic plates, e.g., 4, 6, 8 or more (always even numbers); this makes it possible to increase the strength of the ultrasound wave.

The ceramic constituting the plates of the transducer is not limited to lead titanozirconate; other materials may be suitable for the desired use, to the extent that they have good mechanical resistance enabling them to operate satisfactorily in strong electric fields. It may be pointed out that ceramics of the lead titanozirconate type are available from the firm "Quartz et Silice S.A." under reference P 762.

The invention is perfectly adaptable to the stirring of liquid metal in a mold, e.g., with the assist of a magnetic field rotating about the casting axis, or gliding parallelly or transversely to such axis.

It will be clear that the application of the invention is not limited to continuous casting in vertical molds, but can also be used with inclined, curved, or even horizontal molds. In the case of horizontal molds, which appear to be under development in industry, the mold being fixed to the receptacle which supplies the liquid metal, mechanical oscillation with or without such receptacle involves problems which have not yet been resolved to the knowledge of the present inventors. It is possible that the invention could provide a particularly satisfactory solution to such problems, and that the operation could consist simply of mounting the transducer at the free end opposite that connected to the outlet orifice of the receptacle.

What is claimed is:

1. Vibrating ingot mold for the continuous casting of metals along a casting axis, of the type comprising at least one ultrasonic transducer (8) applied against a tubular internal element (14) of said mold contacting cast metal, said tubular element having an extension and said transducer being directly mounted on the edge (20) of one end of said tubular element in said extension thereof, and being oriented to transmit to said element ultrasonic vibrations generated by said transducer in a longitudinal direction at least substantially parallel to said casting axis (A) in said mold.

2. Vibrating ingot mold according to claim 1, wherein said transducer is a piezoelectric transducer comprising plates (9, 10) of piezoelectric material retained between a metallic transmitter mass (12) and a metallic balancing mass, one of said masses being formed by said tubular internal element (14) itself, one (10) of said plates abutting with one of its faces against said edge (20) of said element, said plates (9, 10) having substantially the same dimensions as said edge (20), and said metallic transmitter mass (12) having a transverse section with the same shape and dimensions as said edge.

3. Vibrating ingot mold according to claim 2, wherein the distance (D) between a free end of said transmitter mass (12) and a free end of said balancing mass (14) is such that $D=k(\lambda/2)$, where k is a whole number and $\lambda$ is the wavelength of said ultrasonic vibrations generated by said transducer (8).

4. Vibrating ingot mold according to claim 2, wherein the dimensions of said transmitter mass (12) are so selected that the distance (D') between a free end of said transmitter mass and a plane of a joint of said plates (9, 10) is such that $D'=\lambda/4+(\eta'\lambda)/2$, where n' is equal to zero or a whole number and $\lambda$ represents the wavelength of ultrasonic vibrations generated by said transducer (8).

* * * * *